United States Patent [19]

Weiler et al.

[11] 4,258,867

[45] Mar. 31, 1981

[54] HERMETICALLY SEALED CONTAINER WITH TWISTABLE OVERCAP

[75] Inventors: Gerhard H. Weiler, South Barrington; Dieter H. Nagel, Des Plaines, both of Ill.

[73] Assignee: Automatic Liquid Packaging, Inc., Arlington Heights, Ill.

[21] Appl. No.: 22,000

[22] Filed: Mar. 19, 1979

[51] Int. Cl.[3] ..... B67B 7/26

[52] U.S. Cl. ..... 222/507; 222/541

[58] Field of Search ..... 222/182, 541, 526, 507, 222/83

[56] References Cited

U.S. PATENT DOCUMENTS

| | | | |
|---|---|---|---|
| 3,263,874 | 8/1966 | Porter et al. | 222/541 X |
| 3,777,949 | 12/1973 | Arias | 222/541 |

*Primary Examiner*—Stanley H. Tollberg

*Attorney, Agent, or Firm*—Dressler, Goldsmith, Shore, Sutker & Millnamow, Ltd.

[57] ABSTRACT

A hermetically sealed container is provided with a neck portion having an end wall defining a container contents-dispensing aperture therein. The aperture is closed with a removable cap structure connected with a frangible web unitary with the end wall and cap so as to seal the container contents-dispensing aperture. An overcap is rotatably mounted on the container and has a cage for matingly engaging the cap and is adapted to break the frangible web when the overcap is rotated.

14 Claims, 11 Drawing Figures

20
A
42
L
10
36
56
32
18
58
50
34
A
44
24
22

36
32
26
28
18
24
22

L
32
36
28
26
30
18
34
24
22

42
54
56
10
53
53
44
50

42'
54'
56'
10'
44'
53'

HERMETICALLY SEALED CONTAINER WITH TWISTABLE OVERCAP

TECHNICAL FIELD

This invention relates to a unitary dispensing vial or container which is hermetically sealed.

BACKGROUND ART

Hermetically sealed containers with unitary closure are known. Such containers can be used to hold liquid contents and may have a unitary nozzle with the discharge end of the nozzle closed off. A portion of the nozzle is severed or broken off when it is desired to discharge the liquid contents.

For many applications, such containers function very well. However, in other applications, it may be desirable to have a container which is as small as possible for the given amount of liquid contained therein. This may be especially true where a number of such containers are intended to be packed together for storing or shipping. If the containers have unitary nozzles, each nozzle projects from the main body of its container and may interfere with the packing of the adjacent containers. Further there is a possibility that the nozzle could be accidentally broken during handling, or while the container is being shipped in a package with other containers, and thus permit the contents of the container to drain out.

A way to overcome the above-described problems is to provide a compact, unitary dispensing container which is hermetically sealed but which does not have an outwardly projecting nozzle structure. However, a means must be provided for opening the hermetically sealed container to allow discharge of the contents therefrom. Further, in order to obtain the benefits of a dispensing nozzle, it would be desirable to provide means for permitting the container to be used in conjunction with a separate, but readily attached, nozzle.

SUMMARY OF THE INVENTION

The present invention includes a hermetically sealed container with a remotely openable closure for use with a cooperating rotatable overcap having a dispensing nozzle from which a liquid container contents may be dispensed.

Preferably, the container has a hollow body portion for containing the liquid and a neck portion unitary with the body portion defining a container access opening. The neck portion is hermetically sealed by a closure portion which includes a substantially planar end wall extending across the distal end of the neck portion and unitary therewith. The end wall defines a dispensing aperture therein and has a removable cap situated over the dispensing aperture and secured to the end wall by means of a frangible web which is unitary with the cap and with the end wall.

The above-described hermetically sealed structure can be fabricated by a variety of means, including blow-molding techniques, with a relatively compact shape adapted for being packaged with a plurality of such containers in a relatively tight packing configuration which makes maximum use of the packing space available.

In order to remove the cap from the dispensing aperture, and to provide the benefits of a nozzle dispensing system, an overcap having a dispensing nozzle can be provided. To this end, the neck portion of the container has an exterior configuration suitable for rotatably mounting the overcap on the neck portion. Such a suitable configuration may include a circumferential protuberance or snap-fit flange structure over which the overcap can be forced, when desired, so that the overcap is retained on the neck portion but is not restrained by the flange structure against rotation relative to the neck portion.

In order to separate the cap from the aperture, the cap preferably has an engagable shape or structure, such as an upstanding fin, and the overcap has a retainer means for mating with and engaging the cap or fin. Then, when the overcap is rotated on the neck portion of the container, the cap is moved by the retainer means within the overcap to break the frangible web and expose the dispensing aperture.

In one embodiment, the dispensing aperture is generally aligned on the longitudinal axis of the rotatable dispensing nozzle. The aperture and overlying cap have a non-circular configuration, such as an elliptical shape, so that when the overcap is rotated, the retainer means rotates the elliptical cap to break the frangible web and orient the cap so that it is out of registry with the underlying dispensing aperture, thereby providing portions of the aperture on either side of the rotated cap through which the container contents may flow. If desired, the retainer means within the overcap may be formed to allow the cap, after it is broken from the neck portion, to move outwardly away from the neck portion to provide a greater flow path for the fluid discharging through the dispensing aperture.

In another embodiment, the dispensing aperture and cap are displaced radially outwardly on the end wall of the neck portion from the longitudinal axis of the rotatable overcap. Then, when the overcap is rotated, the frangible web is broken and the cap is moved along a circular arc with the overcap away from the dispensing aperture to thereby expose the entire aperture and allow the fluid contents to flow through the aperture unhindered.

The container may be a rigid tubular structure, a generally flexible tubular structure, or a collapsible bellows-type structure. With a bellows structure, the overcap means can be provided with outwardly projecting finger rest members which permit the overcap to be held by two fingers while the bottom of the container is pushed by the thumb toward the neck portion to aid in dispensing the contents from the container.

Numerous other advantages and features of the present invention will become readily apparent from the following detailed description of the invention, from the claims, and from the accompanying drawings.

BRIEF DESCRIPTION OF THE DRAWINGS

In the accompanying drawings forming part of the specification, and in which like numerals are employed to designate like parts throughout the same.

DESCRIPTION OF THE PREFERRED EMBODIMENT

Figure 1:
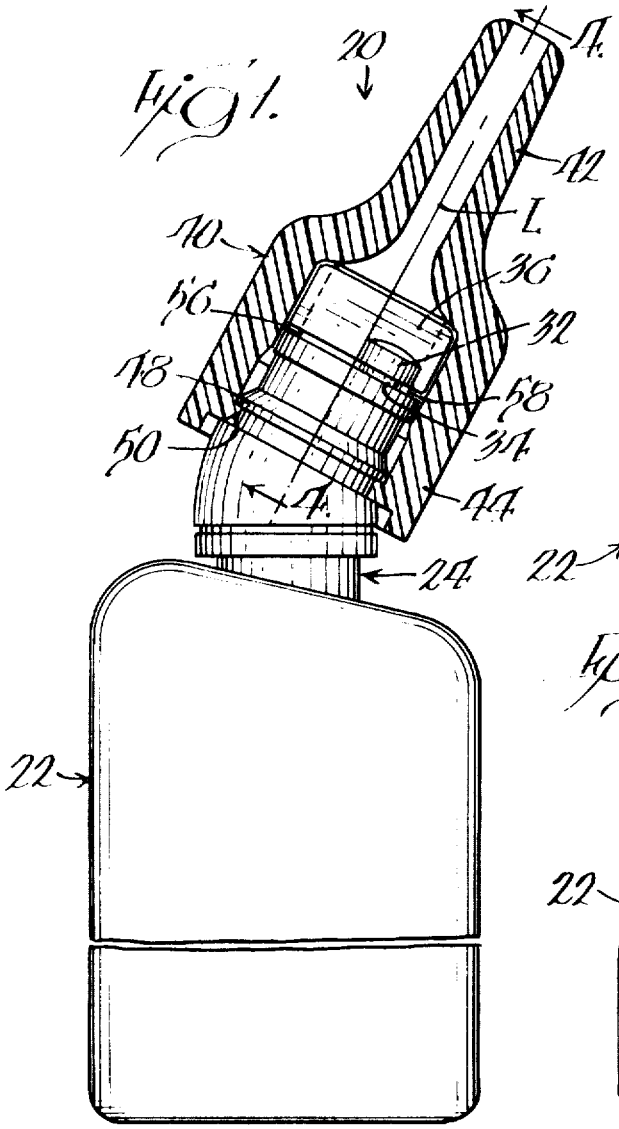
FIG. 1 is a side elevational view of a hermetically sealed container embodying the closure and twistable overcap of the present invention with the twistable overcap show in cross-section.

While this invention is susceptible of embodiment in many different forms, there are shown in the drawings and will herein be described in detail preferred embodiments of the invention. It should be understood, however, that the present disclosure is to be considered as an exemplification of the principles of the invention and is not intended to limit the invention to the embodiments illustrated.

The precise shapes and sizes of the components herein described are not essential to the invention unless otherwise indicated, since the invention is described with reference to an embodiment which is simple and straight forward.

For ease of description, the apparatus of this invention will be described in a normal operating position, and terms such as upper, lower, horizontal, etc., will be used with reference to this normal operating position. It will be understood, however, that the apparatus of this invention may be manufactured, stored, transported and sold in an orientation other than the normal operating position described.

In FIG. 1, a hermetically sealed container embodying the closure and twistable overcap in accordance with the present invention is designated generally as 20. The container has a hollow body portion 22 which, as illustrated in FIGS. 2 and 3, may have a tubular shape for containing a liquid therein.

At one end of the hollow body portion 22 is an outwardly projecting or upstanding neck portion 24. The neck portion defines a container access opening and is unitary with the hollow body portion 22. If desired, and as illustrated in FIGS. 1-3, the neck portion 24 may be conveniently angled for use when dispensing liquid from the container in certain applications.

Figure 2:
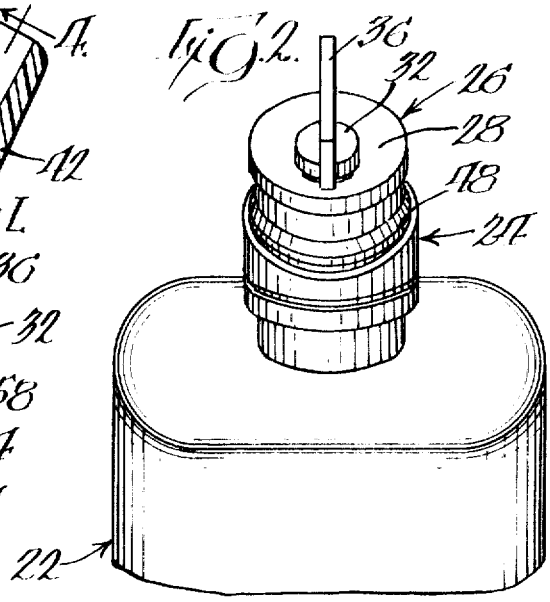
FIGS. 2 and 3 are fragmentary perspective views of the top portion of the container and closure portion with the twistable overcap removed to show the operation of the removable cap.
Figure 3:
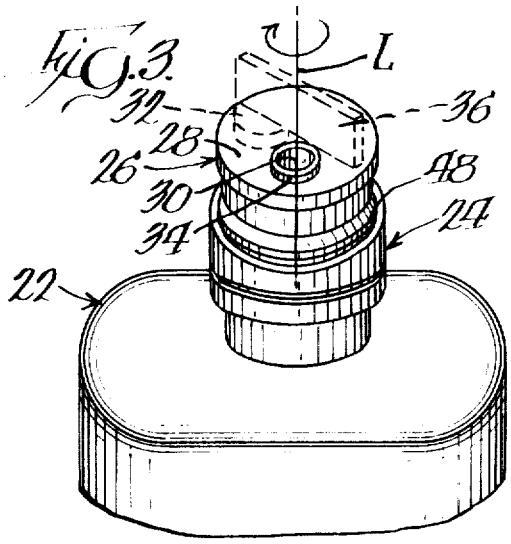

As illustrated in FIGS. 2 and 3, the distal end portion of the neck portion 24 includes a closure portion 26 which is unitary with the neck portion and closes over the container access opening. The closure portion includes an end wall 28 which may be generally planar, and in the embodiment illustrated, may be a generally disc-like membrane. Defined within the end wall 28 is a container contents-dispensing aperture 30 which is unitary with the neck portion 24 through which the liquid is passed during discharge of the container contents.

A removable cap means or cap 32 is situated over the contents-dispensing aperture and is secured to the end wall 28 over the aperture 30 by a frangible web 34 which is unitary with the end wall 28 of the neck portion 24.

The cap 32 is preferably formed with an exterior configuration that allows it to be easily engaged by a suitable mating retainer or engaging means, as will be explained in more detail hereinafter, so that force can be applied to cap 32 for breaking the frangible web 34 connecting the cap 32 to the end wall 28 and for then displacing the cap 32 away from the underlying aperture 30 to thereby allow the liquid contents of the container to pass through the aperture 30 as desired.

With reference to FIGS. 2 and 3, the cap 32 has a specific engageable structure in the form of a generally right rectangular prism or fin 36 which is integral with, and projects upwardly from, cap 32.

In the embodiment illustrated in FIGS. 1, 2 and 3, the dispensing aperture 30 and overlying cap 32 each have a generally circular configuration and are located so that their centers are coincident and are both spaced outwardly of the longitudinal axis L of the angled distal end portion of the neck portion 24. This offset orientation of the aperture 30 and overlying cap 32 functions, as will be explained in detail below, to permit the cap 32 to be easily displaced away from the aperture 30 to provide an unhindered free-flow path for the liquid out of the container.

A novel overcap 40 may be provided in accordance with the present invention to be removably engaged with the neck portion 24 when it is desired to discharge some or all of the liquid contents of the container 22. The overcap 40 has a distal end nozzle section 42 and a base section 44. The base section 44 is adapted to engage the neck portion 24 after the overcap has been forced against the neck portion 24.

To provide a convenient means of connecting the overcap 40 with the neck portion 24, the neck portion 24 is preferably generally cylindrical and has an outwardly extending circumferential protuberance or flange 48. The overcap 40 has an inwardly projecting circumferential protuberance or flange 50 adapted to ride over and past the protuberance 48 of the neck portion 24 when the overcap 40 is pushed onto the next portion 24.

Typically this construction employs a conventional snap-fit design, the operation of which is wellknown to those skilled in the art. In general, the wall of the base portion 44 of the overcap 40 is forced outwardly so that it expands circumferentially a small amount as the inwardly projecting protuberance or flange 50 passes over the flange 48 on the container neck portion 24. After the overcap flange 50 has passed beyond the neck portion flange 48, the wall of the base portion 44 of the overcap is free to assume its normal configuration and moves the flange 50 inwardly to retain the overcap 40 on the neck portion 24 and to prevent accidental disengagement of the overcap 40 from the neck portion 24. The configuration of the snap-fit flanges 50 and 48 are preferably designed to provide a connection which is leak-tight yet permits the overcap 40 to rotate on, and relative to, the neck portion 24.

Figure 4:
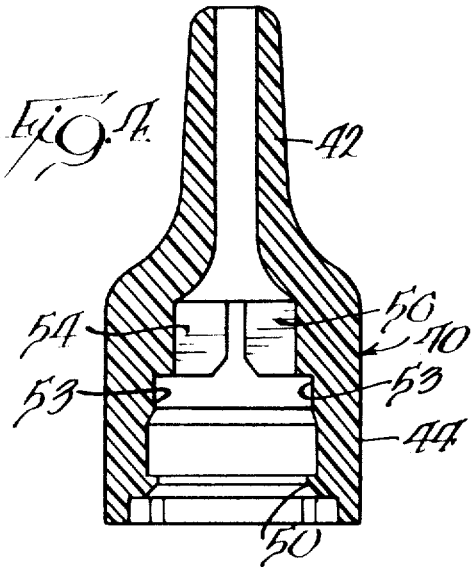
FIG. 4 is a cross-sectional view of the twistable overcap taken generally along the plane 4—4 in FIG. 1.

As illustrated in FIG. 4, the interior of the base portion 44 of the overcap 40 is adapted to receive the distal end of the neck portion 24, and particularly to receive the cap 32 and outwardly projecting fin 36. The overcap 40 is especially designed to provide a retainer means comprising a generally cylindrical cage means or cage 53 for receiving the cap 32 and two pairs of walls at diametrically opposed locations on the interior of base portion 44, one pair of walls visible in FIG. 4 where the walls are individually designated as 54 and 56. On the opposite side, as illustrated in FIG. 1, a small portion of one wall 58 of the other pair of walls is visible. These walls engage the sides of the fin 36 and serve to retain the fin 36 therein.

When the overcap is rotated on the neck portion 24 the frangible web 34 securing the cap 32 over the dispensing aperture 30 to the end wall 28 is broken and the cap 32 is revolved away from the aperture 30 about the longitudinal axis L to a location spaced away from the aperture 30 to provide an unobstructed flow path through the aperture 30.

Figure 5:
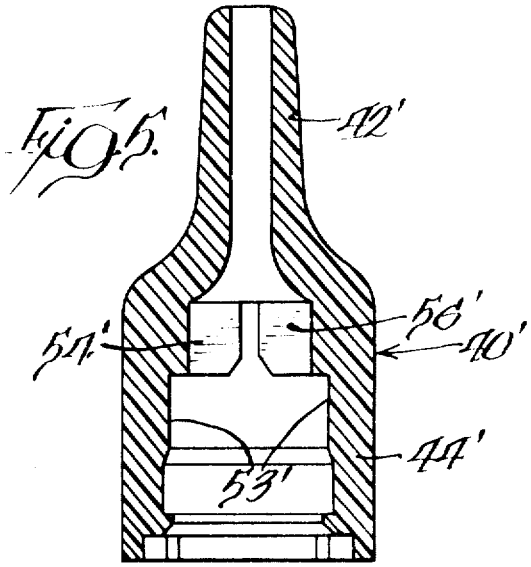
FIG. 5 is a view similar to FIG. 4 but showing a modification of the twistable overcap.

A modification of the overcap is illustrated in FIG. 5 wherein an overcap 40' has a nozzle 42' and a base portion 44'. The interior of the base portion 44' includes two pairs of fin engaging walls, such as one pair 54' and 56' visible in FIG. 5. The fin 36 of cap 32 can slide upwardly between the walls 54' and 56' after the cap 32 has been broken from the end wall 28.

The base portion 44' also defines therein a cylindrical cage 53' which is generally higher than the corresponding cage 53 of the first embodiment illustrated in FIG. 4. The increased height within the cage 53' allows the cap 32 to be moved upwardly and outwardly away from the end wall 28 after it has been broken away from the frangible web 34.

With the modified overcap 40' as illustrated in FIG. 5, it is not necessary to locate the circular dispensing aperture 30 and cap 32 in an offset relationship with respect to the longitudinal axis L of the neck portion 24. If desired, the circular aperture 30 and disc-like cap 32 could be located on the end wall 28 so that their centers are coincident with the longitudinal axis L of the container neck portion 24. Then, when the overcap 40' is twisted or rotated about the axis L (FIG. 3), the frangible web 34 would break and, although the cap 32 would not be revolved laterally away from the aperture 30, the cap 32 would be free to move upwardly and outwardy away from the end wall 28 and away from the aperture 30 to thereby provide an unobstructed flow path for the liquid through the aperture 30 and into the nozzle 42'.

A modification of the container of the present invention is illustrated in FIGS. 6–9 wherein a container 120 has a collapsible bellows-type body 122 and a generally cylindrical neck portion 124 which, unlike the first embodiment illustrated in FIGS. 1–4, is not angled. Specifically, the body 122 is formed with a series of circumferential, flexible pleats 123 that permit collapse of the container body 122 upon application of a compressive force along the longitudinal dimension of the body.

Figure 6:
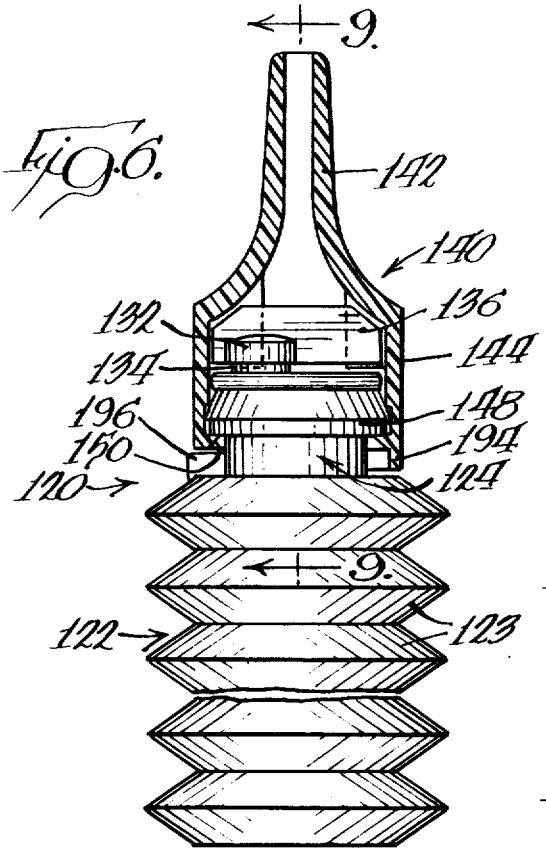
FIG. 6 is a side elevational view of another embodiment of a hermetically sealed container of the present invention with the twistable overcap shown in cross section.

The neck portion 124 has a retaining flange 148, and an end wall 128 (FIG. 7) defining an aperture 130 therein. A cap 132 is situated over the aperture and is secured to the aperture 130 by a frangible web 134 (FIG. 6).

Projecting upwardly from the cap 132, and unitary therewith, is an engageable fin 136 by which the cap 132 can be forced relative to the end wall 128 to break the frangible web 134.

An overcap 140, having a nozzle 142 and a base portion 144, is provided for being removably secured to the neck portion 124 and held thereon against the neck portion flange 148 with an inwardly projecting flange 150. As in the first embodiment, the overcap 140 is adapted to be engaged with the neck portion 124 in a leak-type, but rotatable, manner.

Figure 9:
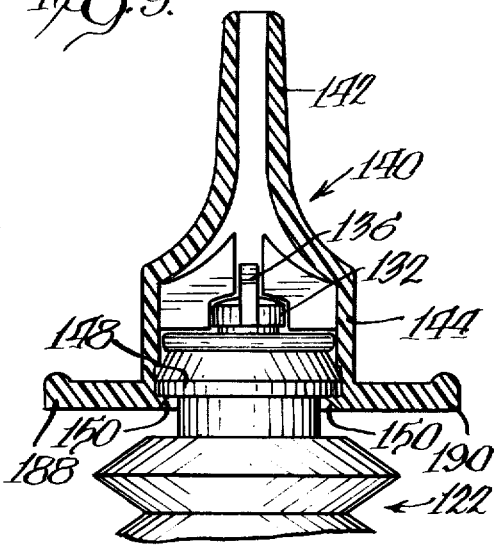
FIG. 9 is a fragmentary side elevational view of the container illustrated in FIG. 6 with the twistable overcap shown in cross section, said cross section being taken generally along the plane 9—9 in FIG. 6.
Figure 8:
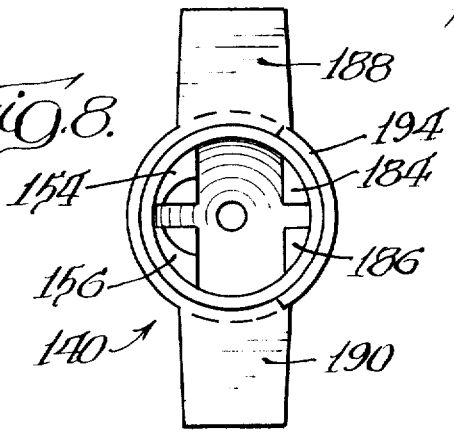
FIG. 8 is a bottom plan view of the twistable overcap illustrated in FIG. 6 removed from the container and showing the inside of the overcap.

With reference to FIGS. 8 and 9, the overcap 140 is seen to have a cap retainer means which includes a pair of walls 154 and 156 and pair of walls 184 and 186. The pairs of walls are adapted to engage the sides of the fin 136 so that when the overcap 140 is rotated relative to the neck portion 124, the fin 136 and cap 132 connected thereto, are moved to break the connection at the frangible web 134. To this end, the aperture 130 and overlying cap 132 may be located on the end wall 128 with their centers displaced from the longitudinal axis of the generally cylindrical neck portion 124. Then, when the overcap 140 is rotated, the cap 132 is broken away from the end wall 128 and revolved in a generally circular arc away from the aperture 130.

If desired, the overcap 140 can be provided with a downwardly extending lug 194 as illustrated in FIG. 6 and the neck portion 124 can be provided with an outwardly extending lug 196 for engaging the lug 194 when the overcap 140 is rotated beyond a predetermined amount.

As an additional convenience, outwardly projecting exterior members 188 and 190 (FIGS. 8 and 9) are provided on overcap 140 to permit the container 120 to be held in one hand with the thumb at the bottom of the container and with a finger on each of the members 188 and 190 whereby the container to be squeezed by the thumb to collapse the container and aid in dispensing the liquid contents therefrom.

Figure 10:
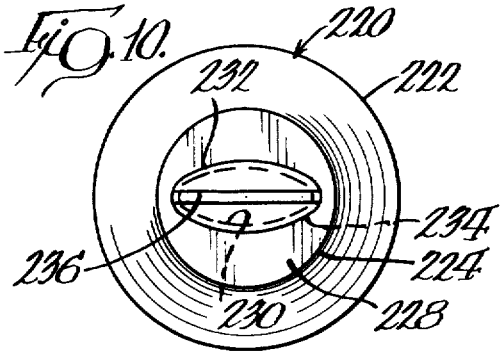
FIG. 10 is a top view of a modification of the container illustrated in FIGS. 6 through 9 and showing a cap in the sealed position.
Figure 7:
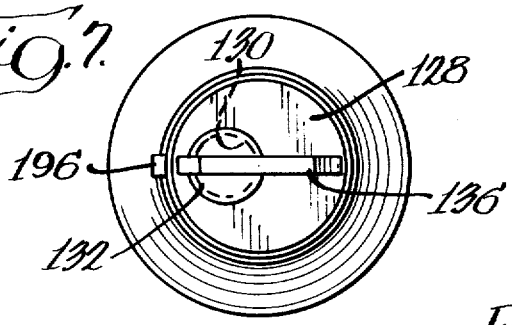
FIG. 7 is a plan view of the top of the container illustrated in FIG. 6 with the twistable overcap removed.
Figure 11:
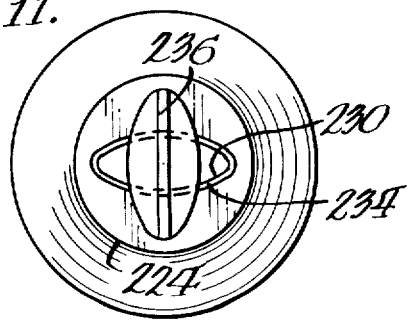
FIG. 11 is a view of the container illustrated in FIG. 10 but showing a rotated position of the cap in dashed lines.

FIGS. 10 and 11 illustrate, schematically in plan view, another form of the container of the present invention. Specifically, the container 220 is provided with a generally cylindrical or tubular body portion 222 and a neck portion 224. The neck portion has a closure end wall 228 in which is defined a dispensing aperture 230. The dispensing aperture 230 may have a non-circular configuration such as an oblong or elliptical configuration. Situated over the oblong aperture 230 is a cap 232 having a generally similar oblong configuration secured around the periphery of the dispensing aperture 230 to the end wall 228 by a frangible web 234. The aperture 230 and cap 232 may be located on a generally cylindrical neck portion 224 with their central axes coincident with the longitudinal axis of the cylindrical neck portion 224.

The cap 232 preferably has an engageable structure 236 similar to the fins 36 and 136 described above with respect to the other embodiments. An overcap, not illustrated, but similar to the overcaps 40 and 140 previously described, may be employed to fit over the neck portion 224 and to engage the fin structure 236. Upon rotation of the overcap, the oblong cap 232 is rotated about its axis and about the longitudinal axis of the neck portion 224 a predetermined amount so that it is moved out of registry with the underlying dispensing aperture 230 and so that portions of the aperture 230 are exposed to provide a free flow path for the fluid contents from the container.

With this type of non-circular, but centrally located cap and aperture illustrated in FIGS. 10 and 11, it is desirable to provide an overcap with a receiving cage having a height greater than the thickness of the cap to permit the cap to move upwardly away from the aperture after the frangible web has been broken in a manner similar to that described with reference to the overcap embodiment illustrated in FIG. 5.

From the foregoing, it will be observed that numerous variations and modifications may be effected without departing from the true spirit and scope of the novel concept of the invention. It is to be understood that no limitation wth respect to the specific apparatus illustrated herein is intended or should be inferred. It is, of course, intended to cover by the appended claims all such modifications as fall within the scope of the claims.

We claim:

1. A hermetically sealed container comprising:
a hollow body portion for containing a liquid;
a neck portion at one end of said hollow body portion, defining a container access opening and unitary with the hollow body portion;
a closure portion at the distal end of said neck portion and unitary therewith;
said closure portion including a substantially planar end wall extending across said access opening, a removable cap means, and a frangible web unitary with said cap means and said end wall;
an overcap covering said closure portion, rotatably mounted on said neck portion, and provided with an integral dispensing nozzle, said nozzle spaced from and communicating with said closure portion end wall;
said closure portion end wall defining a container contents-dispensing aperture therein and being unitary with said neck portion;
said removable cap means beig situated over said aperture; and
said overcap being provided with retainer means mating with said removable cap means and adapted to break said frangible web when the overcap is rotated.

2. The container in accordance with claim 1 in which said neck portion is generally cylindrical, in which said overcap is mounted on said neck portion for rotation about the longitudinal axis of the neck portion, and in which said aperture and overlying cap means are radially spaced away from said longitudinal axis; whereby when said overcap is rotated, said cap means is moved away from said aperture so as to provide a free flow path for said liquid out of said hollow body portion and through said nozzle.

3. The container in accordance with claim 2 in which said neck portion is provided with an outwardly extending circumferential protuberance and in which said overcap is retained in place on said neck portion by said protuberance.

4. The container in accordance with claim 1 in which said cap means has a generally disc-like configuration with an upstanding fin adapted to mate with said overcap.

5. The container in accordance with claim 1 in which said neck portion is generally cylindrical and in which said end wall defines said container contents-dispensing aperture therein with a non-circular configuration, whereby when said overcap is rotated a predetermined amount, said cap means rotates together with said overcap about the longitudinal axis of said generally cylindrical neck portion to break said frangible web and exposed at least a portion of said aperture 6. The container in accordance with claim 5 in which said end wall defines a container contents-dispensing aperture therein having a generally oblong configuration.

7. The container in accordance with claim 6 in which said end wall defines a container contents-dispensing aperture therein having a generally elliptical configuration.

8. The container in accordance with claim 5 in which said retainer means of said overcap defines a cap receiving cage means extending outwardly from said end wall for permitting said removable cap means to move away from said end wall when said frangible web is broken so as to provide a free flow path for said liquid out of said hollow body portion and through said nozzle.

9. The container in accordance with claim 8 in which said cap receiving cage means includes at least one pair of spaced apart wall members.

10. The container in accordance with claim 1 in which said cap means has a generally cylindrical, disc-like configuration; in which said neck portion is generally cylindrical; in which said cap means is oriented on said end wall with the center of the cap means substantially coincident with the longitudinal axis of said neck portion; and in which said retainer means of said overcap defines a cap receiving cage means for permitting said cap means to move outwardly from said end wall after said frangible web has been broken so as to provide a free flow path for said liquid out of said hollow body portion and through said nozzle.

11. The container in accordance with claim 1 in which said overcap has outwardly projecting exterior members.

12. The container in accordance with claim 1 in which said neck portion has a generally cylindrical configuration and in which said neck portion has a circumferential snap-fit protuberance for engaging and retaining said overcap in a snap-fit interlock while permitting rotation of said overcap relative to said neck portion.

13. The container in accordance with claim 1 in which said cap means has a generally disc-like configuration; in which said neck portion is generally cylindrical; in which said cap means is located on said end wall with the center of said cap means displaced from the longitudinal axis of said cylindrical neck portion whereby said overcap can be rotated to break said frangible web and carry said cap away from said aperture on an arc of revolution around the longitudinal axis of said generally cylindrical neck portion so as to provide a free flow path for said liquid out of said hollow body portion and through said nozzle.

14. A hermetically sealed container comprising:
a hollow body portion for containing a liquid;
a generally cylindrical neck portion at one end of said hollow body portion, defining a container access opening and unitary with the hollow body portion;
a closure portion at the distal end of said neck portion and unitary therewith;
an overcap covering said closure portion, rotatably mounted on said neck portion, and provided with an integral dispensing nozzle;
said closure portion including a substantially planar end wall extending across said access opening, a removable cap means, and a frangible web unitary with said cap means and said end wall;
said end wall defining a container contents-dispensing aperture therein and being unitary with said neck portion;
said removable cap means including a generally cylindrical disc-like cap with an outwardly projecting fin; said removable cap means being situated over said aperture on said end wall with the center of the disc-like cap substantially coincident with the longitudinal axis of said neck portion; and said overcap being provided with a cap receiving cage means for mating with said cap and fin to break said frangible web when the overcap is rotated; said cap receiving cage means permitting said cap and fin to move outwardly from said end wall after said frangible web has been broken so as to provide a free flow path for said liquid out of said hollow body portion and through said nozzle.

* * * * *